US009340305B2

(12) United States Patent
Kuhn et al.

(10) Patent No.: US 9,340,305 B2
(45) Date of Patent: May 17, 2016

(54) DISPENSING DEVICE FOR A FLOWABLE PRODUCT

(71) Applicant: Rovema GmbH, Fernwald-Annerod (DE)

(72) Inventors: Roland Kuhn, Reiskirchen (DE); Volker Dersch, Gruenberg (DE); Gunter Brueck, Reiskirchen (DE)

(73) Assignee: ROVEMA GMBH, Fernwald-Annerod (DE)

( * ) Notice: Subject to any disclaimer, the term of this patent is extended or adjusted under 35 U.S.C. 154(b) by 276 days.

(21) Appl. No.: 13/916,103

(22) Filed: Jun. 12, 2013

(65) Prior Publication Data

US 2014/0000758 A1 Jan. 2, 2014

(30) Foreign Application Priority Data

Jun. 13, 2012 (DE) ..... 10 2012 209 924

(51) Int. Cl.

| | |
|---|---|
| ***B65B 1/12*** | (2006.01) |
| ***B65B 31/04*** | (2006.01) |
| ***B65B 39/04*** | (2006.01) |
| ***B65B 9/20*** | (2012.01) |
| ***B65B 9/22*** | (2006.01) |
| ***B65B 37/10*** | (2006.01) |

(52) U.S. Cl.

CPC ... *B65B 1/12* (2013.01); *B65B 9/20* (2013.01); *B65B 9/22* (2013.01); *B65B 31/045* (2013.01); *B65B 37/10* (2013.01); *B65B 39/04* (2013.01); *B65B 2210/10* (2013.01)

(58) Field of Classification Search

CPC ..... B65B 1/04; B65B 1/10; B65B 1/12; B65B 1/26; B65B 9/023; B65B 9/06; B65B 9/10; B65B 9/15

USPC ..... 141/10, 114, 313–314, 316–317

See application file for complete search history.

(56) References Cited

U.S. PATENT DOCUMENTS

| | | | | |
|---|---|---|---|---|
| 3,879,917 | A | 4/1975 | Bassendale et al. | |
| 4,241,563 | A | 12/1980 | Muller et al. | |
| 4,617,779 | A * | 10/1986 | Nygren et al. | 53/433 |
| 5,255,497 | A * | 10/1993 | Zoromski et al. | 53/551 |
| 5,548,947 | A * | 8/1996 | Fincham et al. | 53/551 |
| 5,893,260 | A * | 4/1999 | McKenna | 53/451 |
| 6,662,832 | B2 * | 12/2003 | Baker | 141/234 |
| 6,904,737 | B2 * | 6/2005 | Engesser et al. | 53/451 |

(Continued)

FOREIGN PATENT DOCUMENTS

| | | |
|---|---|---|
| DE | 2931527 A1 | 4/1980 |
| DE | 3640520 A1 | 6/1988 |

(Continued)

OTHER PUBLICATIONS

Machine translation of DE19719339C1, Sep. 10, 1998, all pages.*

*Primary Examiner* — Nicolas A Arnett

(74) *Attorney, Agent, or Firm* — Quarles & Brady LLP

(57) ABSTRACT

A dispensing device for a flowable, in particular powdery product, includes at least one screw conveyor discharging the product, a drive for rotating the screw conveyor about its longitudinal axis, and a forming tube for guiding a tubular film. The screw conveyor protrudes with its longitudinal axis into the forming tube, wherein at least one screw guide, in which the screw conveyor is guided transversally to its longitudinal axis, is formed by the inner wall of at least one cylindrical recess in the forming tube.

10 Claims, 5 Drawing Sheets

(56) References Cited

U.S. PATENT DOCUMENTS

| | | | | |
|---|---|---|---|---|
| 7,028,448 | B2 * | 4/2006 | Engesser et al. | 53/451 |
| 7,028,451 | B2 * | 4/2006 | Braun et al. | 53/550 |
| 7,958,697 | B2 * | 6/2011 | Rapparini | 53/425 |
| 8,857,675 | B2 * | 10/2014 | Gysel et al. | 222/413 |
| 2002/0157729 | A1 * | 10/2002 | Baker | 141/234 |
| 2012/0132316 | A1 * | 5/2012 | Nielsen | 141/10 |
| 2012/0279999 | A1 * | 11/2012 | Gysel et al. | 222/413 |

FOREIGN PATENT DOCUMENTS

| | | | |
|---|---|---|---|
| DE | 9306944 | U1 | 7/1993 |
| DE | 19719339 | C1 | 9/1998 |
| DE | 19719337 | A1 | 11/1998 |

* cited by examiner

DISPENSING DEVICE FOR A FLOWABLE PRODUCT

CROSS REFERENCE TO RELATED APPLICATION

This application claims the priority benefit of German Patent Application No. 10 2012 209 924.7 filed on Jun. 13, 2012, which is fully incorporated herein by reference.

STATEMENT REGARDING FEDERALLY SPONSORED RESEARCH OR DEVELOPMENT

Not applicable.

FIELD OF THE INVENTION

The invention relates to a dispensing device for a flowable, in particular powdery product. Generic dispensing devices are used in particular for filling tubular bags in tubular bag machines. The product can be transported by a screw conveyor from a silo into the storage container of the dispensing device and from there be filled in portions by the screw conveyor into the tubular bag produced in the tubular bag machine, respectively. The number of rotations of the screw conveyor corresponds to a specific product mass, which has to be filled into the tubular bag in a defined manner.

BACKGROUND OF THE INVENTION

A generic dispensing device is described, for example, in DE 197 19 339 C1. In this dispensing device, the screw conveyor is guided in a cylindrical screw tube. The screw tube itself is completely filled with the product during the operation of the dispensing device so that by driving the screw conveyor, a specific conveyed amount of the product can be discharged at the end of the screw tube. In this dispensing device, it is furthermore provided that the screw tube itself is arranged in a forming tube. The forming tube serves the purpose of guiding the tubular film, which has been formed from a film web by means of a forming shoulder, towards the sealing jaws of the tubular bag machine in a manner corresponding to a predefined shape. At the end of the forming tube, the product conveyed by the screw conveyor can be filled into the open cross section of the tubular bag.

The outer cross section of the forming tube results from the shape of the tubular bag to be produced, respectively, so that the inner cross section of the forming tube has an upper limit resulting from the shape of the respective tubular bag. The conveying capacity of the screw conveyor is operatively determined by the inner cross section of the screw tube. In the generic dispensing devices, the screw tube must be plugged into the open cross section of the forming tube, resulting in the fact that also the inner cross section of the screw conveyor is limited by the shape of the tubular bag to be produced, respectively.

Since the forming tube and the screw tube each have to possess a specific mechanical stability, the wall thickness necessary for manufacturing the forming tube and the screw tube also has a minimum limit. In other words, this means that the wall thickness of the forming tube and of the screw tube cannot be arbitrarily decreased because otherwise the forming tube and/or the screw tube would become mechanically unstable. However, since the screw tube must be plugged into the forming tube, the maximally available open inner cross section is consequently constricted by the wall thickness of the material for manufacturing the forming tube and by the wall thickness of the material for manufacturing the screw tube. Thus, the conveying capacity of the known dispensing devices is significantly limited owing to the open maximal cross section constricted by the wall thickness of the forming tube and of the screw tube.

SUMMARY OF THE INVENTION

Therefore, it is the task of the present invention to propose a new dispensing device whose conveying capacity is increased by means of simple measures. This task is solved by a dispensing device including at least one screw conveyor defining a longitudinal axis, a drive rotating the screw conveyor about the longitudinal axis, a forming tube guiding a tubular film, wherein the screw conveyor protrudes longitudinally into the forming tube, and at least one screw guide guiding the at least one screw conveyor transverse to the longitudinal axis and formed by an inner wall of at least one cylindrical recess in the forming tube. Advantageous embodiments of the invention are further described herein.

It is the core of the teaching according to the invention that the screw tube for guiding the screw conveyor can be omitted in the dispensing device according to the invention. The screw guide necessary for the function of the dispensing device is instead formed by the inner wall of a cylindrical recess in the forming tube. In other words, this means that in the device according to the invention a functional integration of the screw guide into the forming tube takes place. Since the screw tube itself is omitted, there is no longer the need to provide the mechanical stability of the screw tube in the dispensing device according to the invention. In consequence, only a sufficient mechanical stability of the forming tube hast to be provided so that the maximal conveying cross section of the screw conveyor with regard to the cross section of the tubular bag to be produced, respectively, is now only constricted by the minimally required wall thickness of the forming tube.

It is generally optional in which manner the cylindrical recess in the forming tube is constructively formed. According to a preferred embodiment, a massive mold, for example made of metal, is used for manufacturing the forming tube. This massive mold can be a one-piece or also a multi-piece mold, which can be disassembled into multiple parts. A cylindrical recess is then introduced into said massive mold, for example by drilling out the mold. If it is a multi-piece mold, the cylindrical recess can be produced in multiple production steps to be effected on the different parts of the mold body, respectively. The maximal conveying cross section of the screw conveyor then results from the minimal wall thickness of the mold between the outer side of the mold and the cylindrical inner side, which serves as a guiding surface for the screw conveyor.

If the forming tube is manufactured from a massive mold, further advantageous variations arise. For example, the forming tube can have at least one open or closed duct. Grooves that are arranged on the outer side or the inner side of the mold shall in particular be considered to be open ducts. Bores that are introduced into the interior of the material of the mold shall in particular also be considered to be closed ducts.

The ducts can serve for the installation of different components or be used for the guiding through of process media. According to a first variation, it is provided that in a negative pressure duct negative pressure can be channeled. The channeling of the negative pressure can take place directly so that the negative pressure duct itself has to be formed pressure-tight. In the alternative, the channeling can also take place indirectly, for which purpose a pressure-tight tube can be installed in the negative pressure duct, for example.

The negative pressure duct can be used for supplying negative pressure to a vacuum head arranged at the end of the forming tube. In this way, otherwise required negative pressure conduits, which are usually installed on the outer side of the dispensing device, can be omitted.

In the alternative or additionally, the negative pressure can also be channeled through the negative pressure duct to an evacuating device arranged at the end of the forming tube. The filled bags can then be evacuated by means of the evacuating device.

According to another embodiment, there can also be one or more actuating means arranged in the duct of the forming tube. Via the actuating means, adjusting motions can be transmitted so as to actuate flaps or seals, for example.

In the alternative or additionally, a gassing duct can be provided in the forming tube, through which a process gas is transported to the tubular bags filled with product at the end of the forming tube. In this way, the process gas can be introduced into the tubular bags before the tubular bags are closed, wherein the gas conduits required otherwise on the outer side of the forming tube can be omitted.

The forming tube can be oriented in an ultimately optional orientation. According to a preferred variation, the forming tube runs substantially vertical.

To be able to maximize the conveying capacity, it can be provided as an additional measure in particular for rectangular tubular bag cross sections that multiple screw conveyors run parallel to one another in the dispensing device. In that case, too, the teaching according to the invention is advantageous because in known dispensing devices a separate screw tube has to be provided for every single screw conveyor, the maximal conveying cross section being constricted in total by the addition of the different wall thicknesses of the individual screw tubes.

If multiple screw conveyors are arranged parallel to one another in the forming tube, an additional variation arises which could not be realized with the previously used screw tubes. It entails embodiments in which the cross sections of the cylindrical recesses running parallel to one another in the forming tube partially overlap. The flanks of the rotating screw conveyors mesh without contact in the overlapping area, for which a synchronous drive has to be customarily provided on the parallel-running screw conveyors. Due to the overlapping of the parallel-running screw conveyors, a mixing of the products transported in on the individual screws can additionally be achieved.

The respective diameter of the different recesses for guiding one screw conveyor, respectively, can be adapted to different requirements during the design of the dispensing device. It can be provided in particular that all recesses have the same diameter. In the alternative, it can also be provided that the cylindrical recesses running parallel to one another in the forming tube have different diameters, respectively. Such variations with differently sized screw conveyors make it possible to easily realize dispensing devices with separately realized coarse dosing devices and fine dosing devices.

To prevent the product from undesirably trickling away while the screw conveyor is standing still, a detention means having recesses for the passage of the product can be provided at the lower end of the screw conveyor. The detention means can be realized for example in the manner of a flap, a slider, a half-shell and/or a vacuum means.

BRIEF DESCRIPTION OF THE DRAWINGS

Different embodiments of the invention are schematically illustrated in the drawing and will be exemplarily explained in the following.

DETAILED DESCRIPTION OF THE EXAMPLE EMBODIMENTS

Figure 1:
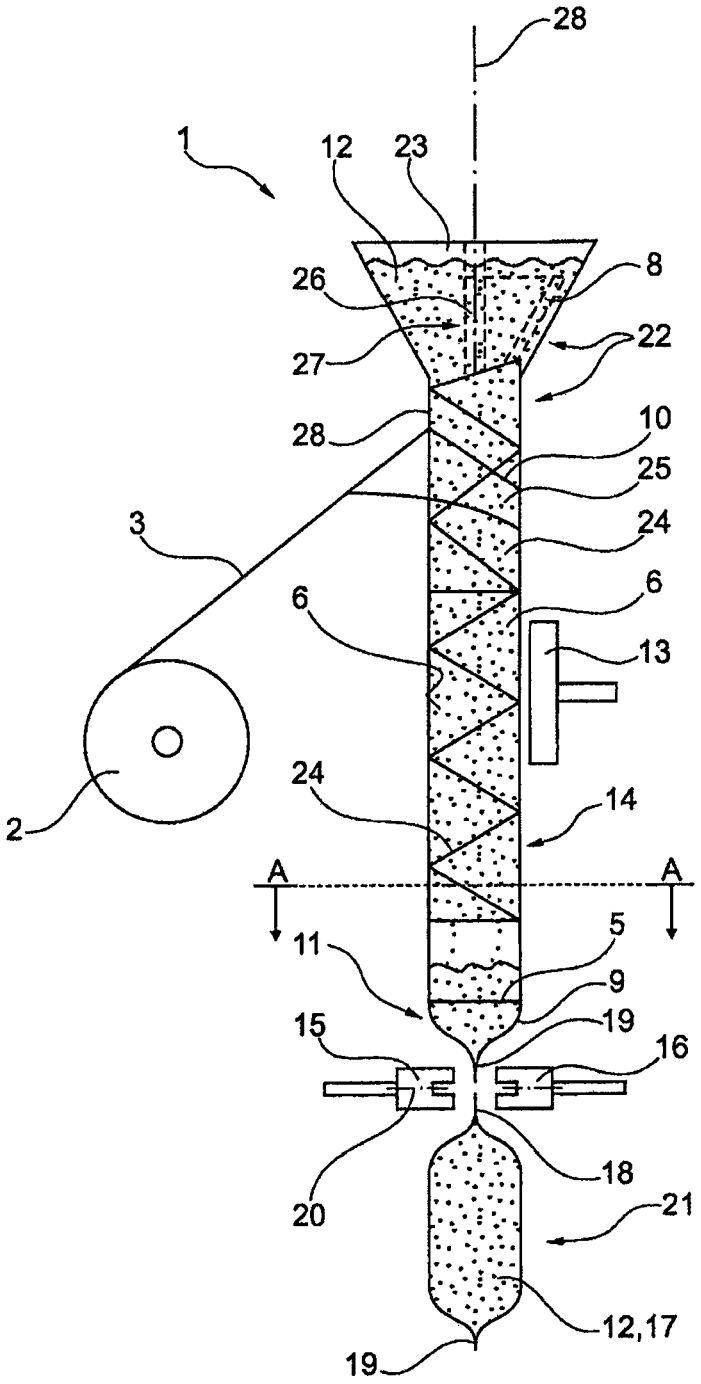
FIG. 1 shows in a schematic lateral view a vertical tubular bag machine comprising a dispensing device according to the invention.

In the vertical tubular bag machine 1 illustrated in FIG. 1, a film web wound onto a supply roll 2 is unwound from the supply roll 2 by means of a film pull-off 4. The film pull-off is composed of two belt pull-offs not illustrated, which are disposed on opposite sides of a forming tube 5. Each of the belt pull-offs not illustrated in FIG. 1 has a belt running about two pulleys. The belts are driven in opposite directions and move downward a tubular film 9 surrounding the forming tube 5 and move the film web 3 over an outer wall 50 of the forming tube 5 towards a forming shoulder 10. At the forming shoulder 10, the flat film web 3 is re-shaped into the tubular film 9. By means of the forming tube 5, a filling of the lower end 11 of the tubular film 9 with a flowable, powdery product 12 is effected.

The tubular film 9 is longitudinally sealed by means of a longitudinal sealing jaw 13 movable against the tubular film 9, forming a longitudinal sealing seam 14. By means of transverse sealing jaws 15 and 16 movable against each other, the end of the tubular film 9, filled with a product portion 17, is transversely sealed, one top seam 18 and one bottom seam 19 being formed, respectively. Once a transverse sealing has taken place, the tubular film 9 is severed by a severing knife 20, which can be actuated in the transverse sealing jaw 15, and a thus produced tubular bag is dropped.

The supplying of the product and the dispensing of individual product portions 17 takes place by means of a dispensing device 22. On the product dispensing device 22, a screw conveyor 24 (see FIG. 2) is provided, which transports the product 12 out of a storage container 23. The screw conveyor 24 is driven to rotate about its longitudinal axis 28 by a drive 26, 27.

Figure 2:
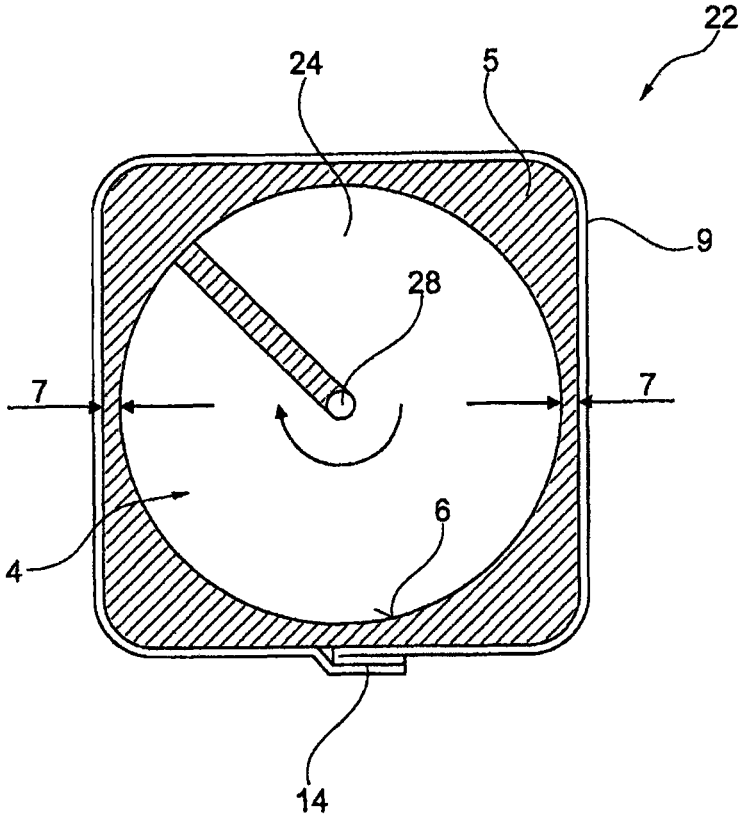
FIG. 2 shows in a horizontal section along the line A-A of FIG. 1 the forming tube of the dispensing device.

FIG. 2 illustrates the dispensing device 22 comprising the forming tube 5, the longitudinally sealed tubular film 9 and the screw conveyor 24 in a cross section along the line A-A. It is visible that the forming tube 5 is manufactured from a massive rectangular mold. A cylindrical recess 4 is introduced into said massive mold. The inner wall 6 of the recess 4 has the purpose of guiding the screw conveyor 24. As it can be taken from FIG. 2, the maximal conveying cross section of the screw conveyor 24 is only limited by the minimal wall cross section 7 of the forming tube 5. The minimal wall cross section 7 results from the necessary mechanical stability of the forming tube 5 in dependence of the material used for manufacture, respectively.

Alternatively to the variation illustrated in FIG. 2, the forming tube 5 can of course also be composed of two parts, which adjoin for example in a separating plane through the longitudinal axis 28. To prevent the product 12 from caking or clumping in the storage container 23, a stirrer 8 co-rotates with the screw conveyor 24 in the storage container 23.

Figure 3:
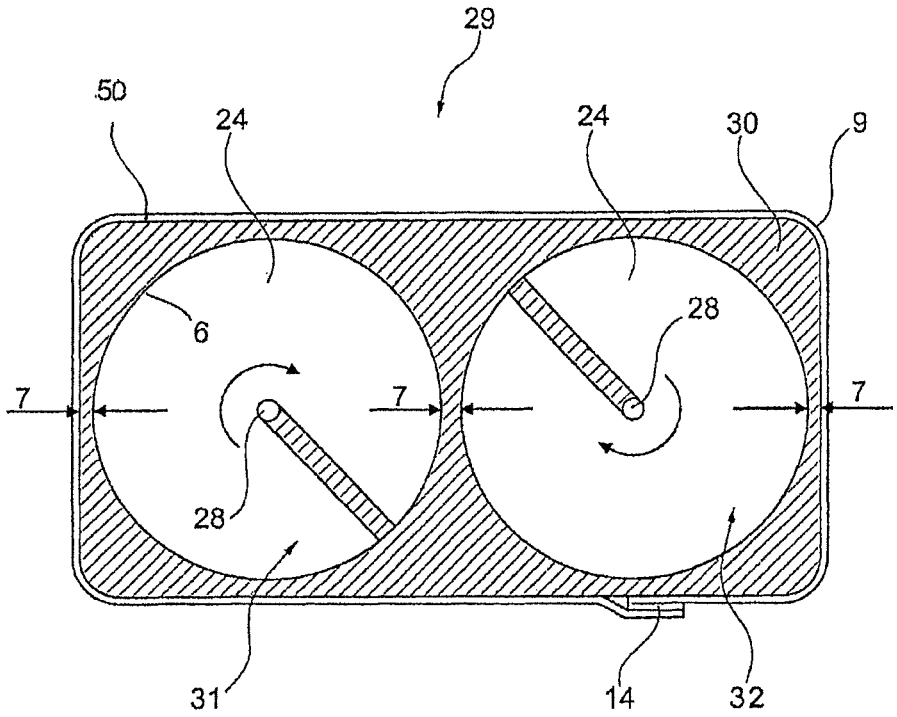
FIG. 3 shows a second embodiment of a forming tube of a dispensing device according to the invention in a cross section.

FIG. 3 shows a second embodiment 29 of a dispensing device in a cross section. The forming tube 30 has two recesses 31 and 32 running parallel to each other, in each of which one screw conveyor 24 is guided. In this implementation variation, the maximally available conveying cross section of the two of the two screw conveyors 24 is limited by the addition of three, respectively two, minimal wall cross sections 7.

Figure 4:
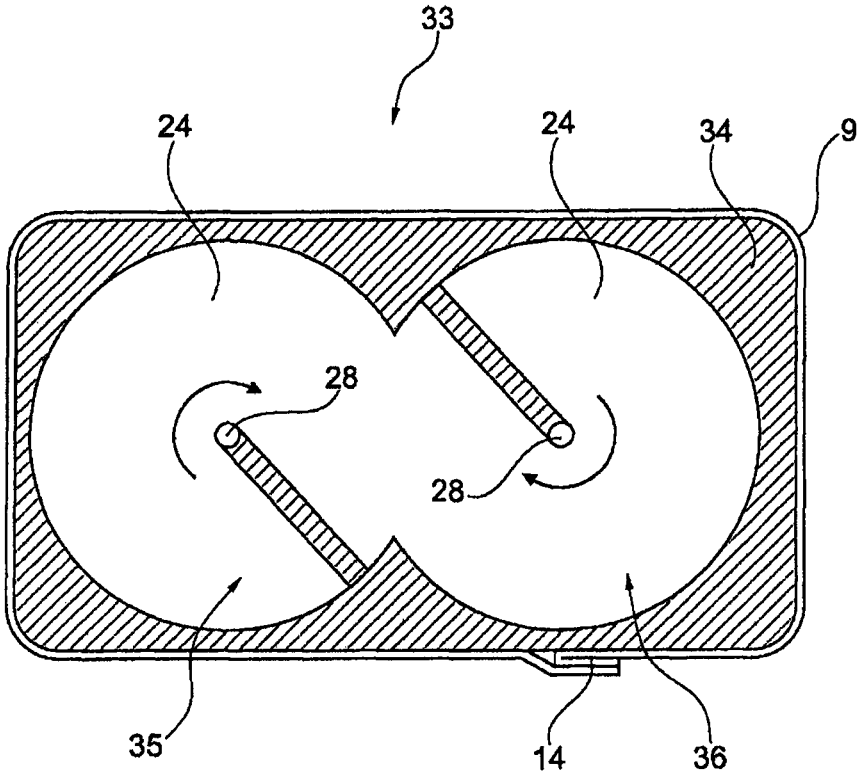
FIG. 4 shows a third embodiment of a forming tube of a dispensing device according to the invention in a cross section.

FIG. 4 shows another alternate embodiment 33 of a dispensing device according to the invention in a cross section. The forming tube 34 again comprises two recesses 35 and 36, in each of which one screw conveyor 24 is guided. In embodiment 33, however, the two recesses 35 and 36 overlap in their central intermediate area so that the screw conveyors 24 rotating in the recesses 35 and 36 mesh without contact in this overlapping area. For the screws 24 to stay out of contact, it is continuously necessary to drive the two screws 24 synchronously to each other.

Figure 5:
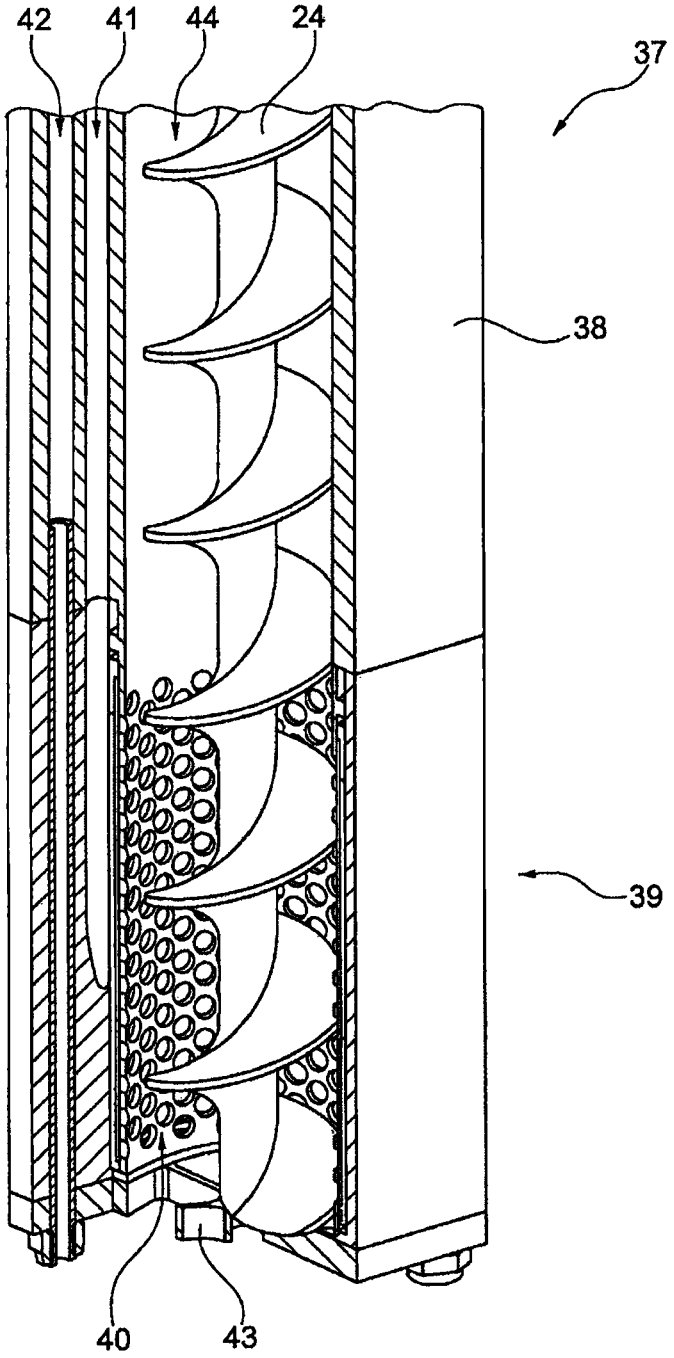
FIG. 5 shows another embodiment of a dispensing device according to the invention in a perspective longitudinal section.

FIG. 5 shows another embodiment 37 of a dispensing device according to the invention in a cut-away longitudinal section. The forming tube 38 comprises a cylindrical recess 44, in which the screw conveyor 24 is guided. On the lower end of the forming tube 34, a vacuum head 39 is additionally arranged. By applying a vacuum to the interior 40 of the vacuum head 39, an undesired trickling-away of the powdery products can be prevented or reduced. To be able to apply the necessary vacuum the interior 40, a negative pressure duct 41 is provided in the forming tube 39, through which negative pressure from a negative pressure source not illustrated can be channeled through the forming tube 38 to the vacuum head 39.

Moreover, the forming tube 38 comprises a gassing duct 42, which can transport a process gas from a process gas source not illustrated through a corresponding gassing duct 43 in the vacuum head 39 towards the lower end of the vacuum head 39. In this way, the process gas can be introduced in a simple manner into the still open tubular bags when the tubular bags are being filled.

Additionally, a plate-shaped detention means 43 is arranged below the end of the screw conveyor 24. The detention means 43 prevents larger clumps of product from falling down and also guides the lower side of the screw conveyor 24. The detention organ 43 has recesses through which the product can be transported when the screw conveyor 24 is rotating.

The invention claimed is:

1. A dispensing device for a flowable product, said device comprising:

at least one screw conveyor defining a longitudinal axis;

a drive rotating the screw conveyor about the longitudinal axis;

a forming tube guiding a tubular film, wherein the screw conveyor protrudes with its longitudinally into the forming tube; and at least one screw guide guiding the at least one screw conveyor transverse to the longitudinal axis and formed by an inner wall of at least one cylindrical recess in the forming tube, wherein multiple screw conveyors are provided, each of which is guided in one cylindrical recess of the forming tube, the recesses running parallel to one another in the forming tube, cross sections of the cylindrical recesses running parallel to one another in the forming tube partially overlap each other, the flanks of the rotating screw conveyors meshing without contact in the overlapping area.

2. The dispensing device according to claim 1, in which the forming tube is manufactured from a mold forming the cylindrical recesses guiding the screw conveyors.

3. The dispensing device according to claim 1, in which the forming tube includes at least one open or closed duct.

4. The dispensing device according to claim 3, in which at least one duct is a negative pressure duct, wherein in the negative pressure duct negative pressure is imparted directly or indirectly via the forming tube.

5. The dispensing device according to claim 4, in which the negative pressure is channeled through the negative pressure duct towards a vacuum head arranged at an end of the forming tube.

6. The dispensing device according to claim 4, in which the negative pressure is channeled through the negative pressure duct towards an evacuating device arranged at an end of the forming tube, wherein filled bags can be evacuated by the evacuating device.

7. The dispensing device according to claim 3, in which the at least one duct is a gassing duct transporting process gas to a tubular bag filled with a product discharged by the at least one screw conveyor.

8. The dispensing device according to claim 1, in which the forming tube is oriented vertically.

9. The dispensing device according to claim 1, in which the cylindrical recesses running parallel to one another in the forming tube have different diameters, the recess with the larger inner diameter being part of a coarse dosing device and the recess with the smaller inner diameter being part of a fine dosing device.

10. The dispensing device according to claim 1, in which on a lower end of each screw conveyor, a detention having recesses for the passage of product is provided.

* * * * *